US009248070B2

(12) United States Patent
Laccitiello

(10) Patent No.: US 9,248,070 B2
(45) Date of Patent: Feb. 2, 2016

(54) METHOD OF PROPPING A COFFIN LID OPEN DURING TRANSPORTATION OF A COFFIN

(71) Applicant: Gilbert Lewis Laccitiello, Hoboken, NJ (US)

(72) Inventor: Gilbert Lewis Laccitiello, Hoboken, NJ (US)

( * ) Notice: Subject to any disclaimer, the term of this patent is extended or adjusted under 35 U.S.C. 154(b) by 0 days.

(21) Appl. No.: 14/619,744

(22) Filed: Feb. 11, 2015

(65) Prior Publication Data

US 2015/0224010 A1 Aug. 13, 2015

Related U.S. Application Data

(60) Provisional application No. 61/939,000, filed on Feb. 12, 2014.

(51) Int. Cl.

| | |
|---|---|
| ***A61G 17/04*** | (2006.01) |
| ***A61G 17/02*** | (2006.01) |
| ***A61G 99/00*** | (2006.01) |

(52) U.S. Cl.

CPC ..... *A61G 17/04* (2013.01); *A61G 17/02* (2013.01); *A61G 99/00* (2013.01)

(58) Field of Classification Search

CPC ..... A61G 17/02; A61G 17/04; Y10S 27/01; Y10T 16/61; Y10T 16/628; Y10T 16/6285; Y10T 16/629; E05C 17/047; E05C 17/54; E05C 19/18; E05C 19/182; E05C 19/188; E05B 65/0057

USPC ..... 27/14, 16, 18, DIG. 1; 220/379; 292/339, 343; 248/351; 16/82, 86 R, 16/86 A, 86 B

See application file for complete search history.

(56) References Cited

U.S. PATENT DOCUMENTS

| | | | | | |
|---|---|---|---|---|---|
| 601,037 | A * | 3/1898 | Garrison | 27/18 |
| RE11,741 | E * | 5/1899 | Garrison | 27/18 |
| 834,489 | A * | 10/1906 | Purdum | 217/61 |
| 1,005,331 | A * | 10/1911 | Schmitt | 27/18 |
| 2,156,872 | A * | 5/1939 | Roberts | 24/329 |
| 2,172,178 | A * | 9/1939 | Rosenberg | 248/118 |
| 2,618,497 | A * | 11/1952 | Gardels | 292/265 |
| 3,959,859 | A * | 6/1976 | Stein et al. | 27/18 |
| 6,209,170 | B1 * | 4/2001 | Huynh | 16/86 A |
| 7,243,406 | B1 * | 7/2007 | Wray | 27/18 |
| 7,866,014 | B2 * | 1/2011 | Bovard | 27/18 |
| 8,075,028 | B1 * | 12/2011 | Porter | 292/338 |
| 8,517,211 | B2 * | 8/2013 | Brown et al. | 220/831 |
| 2005/0050700 | A1 * | 3/2005 | Davis et al. | 27/10 |

* cited by examiner

*Primary Examiner* — William Miller

(57) ABSTRACT

A coffin transport block is provided. The coffin transport block includes a body portion with a top end and a bottom end. Protruding from the top end is a first node and a second node forming a top channel in between. Protruding from the bottom end is a first node and a second node forming a bottom channel in between. A method of use includes the following. The coffin lid may be opened to place the cadaver within the coffin and to prepare the cadaver. The bottom end of the coffin transport block may be placed on a coffin edge so that the coffin edge is within the bottom channel. The lid may be placed on the top end so that the lid edge is within the top channel, thereby propping the coffin in an open position. The cadaver may then be transported to the funeral with the lid of the coffin semi-opened, which prevents the preparation of the cadaver from being disturbed.

6 Claims, 2 Drawing Sheets

METHOD OF PROPPING A COFFIN LID OPEN DURING TRANSPORTATION OF A COFFIN

CROSS-REFERENCE TO RELATED APPLICATION

This application claims the benefit of priority of U.S. provisional application No. 61/939,000, filed Feb. 12, 2014, the contents of which are herein incorporated by reference.

BACKGROUND OF THE INVENTION

The present invention relates to the transportation of coffins and, more particularly, to a portable block for propping open a lid of a coffin during transportation.

Currently, cadavers are transported from the prep area to the viewing funeral area after the cadaver has been prepared. Preparation of the cadaver includes dressing the cadaver with clothing and preparing makeup and a hair style of the cadaver for viewing. To prevent the disruption of the prepared cadaver, it is desirable to keep the coffin open during the transportation from the prep area to the funeral home or viewing area. However, there is currently no device that may be used to do so.

As can be seen, there is a need for a device that keeps the coffins open during transportation.

SUMMARY OF THE INVENTION

In one aspect of the present invention, a method of securing a coffin in an open position comprises: providing at least one coffin transport block comprising: a top end comprising a first node and a second node forming a top channel in between; and a bottom end comprising a first node and a second node forming a bottom channel in between; opening a coffin lid of the coffin; placing the bottom end of the coffin transport block on a coffin edge so that the coffin edge is within the bottom channel; and resting the lid of the coffin on the top end so that the lid edge is within the top channel, thereby propping the coffin in the open position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a coffin transport block. The coffin transport block includes a body portion with a top end and a bottom end. Protruding from the top end is a first node and a second node forming a top channel in between. Protruding from the bottom end is a first node and a second node forming a bottom channel in between. A method of use includes the following. The coffin lid may be opened to place the cadaver within the coffin and to prepare the cadaver. The bottom end of the coffin transport block may be placed on a coffin edge so that the coffin edge is within the bottom channel. The lid may be placed on the top end so that the lid edge is within the top channel, thereby propping the coffin in an open position. The cadaver may then be transported to the funeral with the lid of the coffin semi-opened, which prevents the preparation of the cadaver from being disturbed.

The present invention includes a portable block for transporting open coffins. The present invention may be used for protecting completed cadavers for transporting from the prep area to the viewing funeral home. The present invention prevents the top of the casket from closing. The blocks of the present invention may be carved from wood, or may be manufactured in either plastic or high density foam. The present invention may be designed for morticians to use on completed cadavers for transporting to and from viewing areas. The block holds the top of the coffin open approximately 16" to preserve the finished cadaver.

Figure 1:
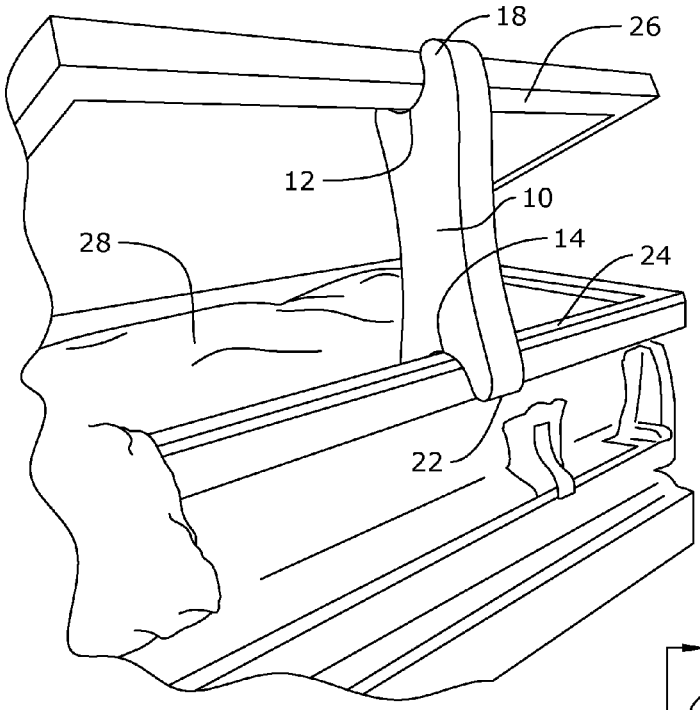
FIG. 1 is a perspective view of an embodiment of the present invention shown in use.
Figure 2:
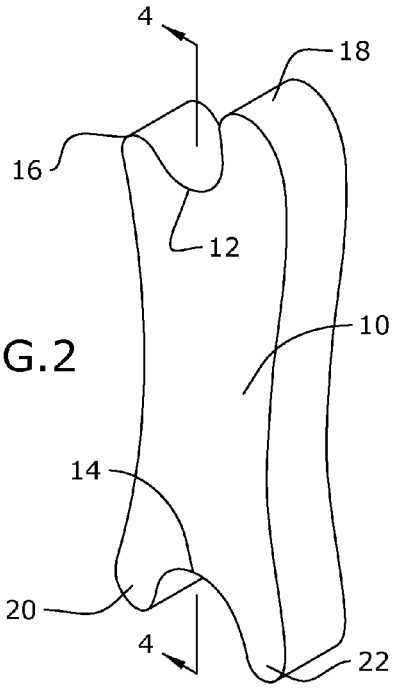
FIG. 2 is a perspective view of an embodiment of the present invention.
Figure 3:
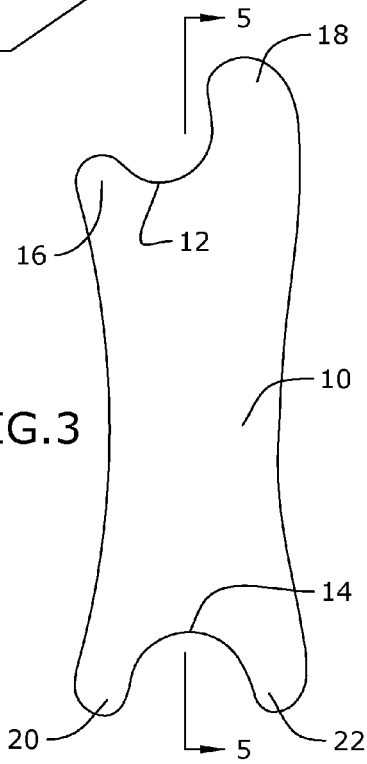
FIG. 3 is a front side view of an embodiment of the present invention.
Figure 4:
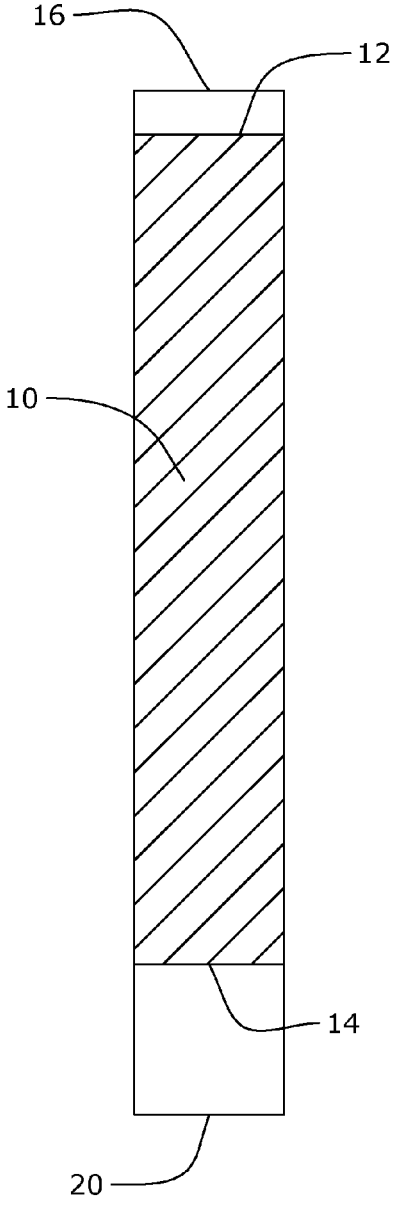
FIG. 4 is a section view taken form 4-4 in FIG. 2.
Figure 5:
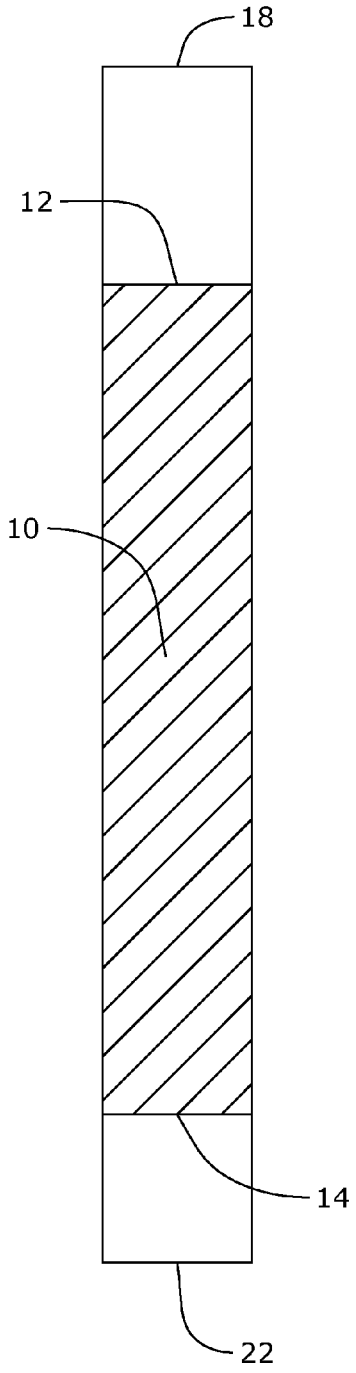
FIG. 5 is a section view taken form 5-5 in FIG. 3.

Referring to FIGS. 1 through 5, the present invention includes a coffin transport block 10. The coffin transport block 10 includes a body portion with a top end and a bottom end. Protruding from the top end may include a first node 16 and a second node 18 forming a top channel 12 in between. Protruding from the bottom end 12 may include a first node 20 and a second node 22 forming a bottom channel 14 in between. The top channel 12 and the bottom channel 14 face away from one another. The bottom channel 14 receives the coffin edge 24 while the top channel 12 receives the lid edge 26, thereby propping the lid in a semi-opened position.

In certain embodiments, the second node 18 of the top end may have a greater length than the first node 16. Further, the top channel 12 may be positioned at an angle facing away from the first node 16. The shape of the top channel 12 thereby conforms to the under surface of a lid so that the edge 26 of the lid may fit within the top channel 12. Further, the top channel 12 and the bottom channel 14 may be U-shaped to receive the edges 24, 26 and secure the edges 24, 26 within.

A method of securing a coffin in an open position may include the following. The coffin transport block 10 mentioned above is provided. The coffin lid 26 may be opened to place the cadaver 28 within the coffin and to prepare the cadaver 28. The bottom end of the coffin transport block 10 may be placed on a coffin edge 24 so that the coffin edge 24 is within the bottom channel 14. The lid may be placed on the top end so that the lid edge 26 is within the top channel 12, thereby propping the coffin in an open position. The cadaver 28 may then be transported to the funeral with the lid of the coffin semi-opened, which prevents the preparation of the cadaver 28 from being disturbed. To provide additional support to the lid, a plurality of coffin transport blocks 10 may be used in the same manner mentioned above. To further secure the lid, an auxiliary strap may be secured to the lid and the coffin to keep the coffin in the semi-opened position.

It should be understood, of course, that the foregoing relates to exemplary embodiments of the invention and that modifications may be made without departing from the spirit and scope of the invention as set forth in the following claims.

What is claimed is:

1. A method of securing a coffin in an open position comprising:

providing at least one coffin transport block comprising:

a top end comprising a first node and a second node forming a top channel in between; and a bottom end opposite the top end comprising a first node and a second node forming a bottom channel in between, wherein the top end and the bottom end are disposed along a common axis of the at least one coffin transport block, the common axis runs in between the first node and the second node of the top end and the first node and the second node of the bottom end, and the top channel is facing an opposite direction as the bottom channel, opening a coffin lid of the coffin, wherein the coffin lid comprises an inside surface facing towards an opening of the coffin;

placing the bottom end of the coffin transport block on a coffin edge so that the coffin edge is within the bottom channel; and resting the lid of the coffin on the top end so that the lid edge is within the top channel, thereby propping the coffin in a semi opened position such that the inside surface of the lid is disposed at an angle less than 90 degrees relative to the coffin.

2. The method of claim 1, wherein the second node comprises a greater length than the first node.

3. The method of claim 2, wherein the top channel is positioned at an angle away from the second node.

4. The method of claim 1, where the at least one coffin transport block is a plurality of coffin transport blocks propping the coffin in the open position.

5. The method of claim 1, wherein the top channel and the bottom channel are U-shaped.

6. The method of claim 1, wherein the at least one coffin transport block is formed of a dense foam.

* * * * *